United States Patent [19]

Saxby

[11] Patent Number: 4,534,370

[45] Date of Patent: Aug. 13, 1985

[54] CIGARETTE EXTINGUISHER AND ASH DISPOSAL DEVICE

[76] Inventor: Robert M. Saxby, 1818 Cleveland St., Hollywood, Fla. 33020

[21] Appl. No.: 537,447

[22] Filed: Sep. 30, 1983

[51] Int. Cl.[3] ..... A24F 19/02; A24F 19/14

[52] U.S. Cl. ..... 131/237; 131/238; 131/235.1

[58] Field of Search ..... 131/235 R, 237, 238; D27/8, 9, 21, 27

[56] References Cited

U.S. PATENT DOCUMENTS

| | | | |
|---|---|---|---|
| 2,760,514 | 8/1956 | Guthrie et al. | 131/237 |
| 3,797,205 | 3/1974 | Weisskopf | 131/238 |
| 4,201,233 | 5/1980 | Jean | 131/237 |

*Primary Examiner*—V. Millin

*Attorney, Agent, or Firm*—Herman J. Hohauser

[57] ABSTRACT

A combination cigarette/cigar extinguisher and ash disposal device made up of four separate single piece construction units removeably connected to each other to form a free standing unit.

4 Claims, 3 Drawing Figures

CIGARETTE EXTINGUISHER AND ASH DISPOSAL DEVICE

BACKGROUND OF THE INVENTION

The present invention relates to a combination cigarette/cigar extinguisher and ash disposal device and is generally a result of the inventor's perception of the growing public awareness of the harmful effects of tobacco smoke and specifically directed to the needs of individual smokers who are being more or more subjected to results of this growing public awareness. Reports from the Surgeon General's office of the United States have made reference to harmful effects from inhalation of smoke mixed with atmospheric air by both smokers and nonsmokers within a room. It has been estimated that approximately 50% of the smoke introduced into the room atmosphere results from smoke directly rising from the burning cigarette or cigar during intervals between puffs, independent of inhalation and exhalation by the smoker. The present invention seeks to lessen that smoke and further make available to the public a device which receives ashes in a less objectionable manner than most presently available and used ash trays.

The design and configuration of the device disclosed and described herein provides for a combination cigarette extinguisher and ash disposal capability not heretofore available to the public at a minimum cost factor. Specifically, the following features are available as a result of the present invention:

1. Convenient resting place for lit cigarettes.
2. Easy to replace parts of the device to provide for the changing of color combinations and/or removal of damaged portions resulting from burn, scratches or the like.
3. Quick extinguishing of lit cigarette so as to be able to re-light at a later time.
4. Ash disposal in such a way that so as to be hidden from view and stored in an entirely enclosed area so as not to spill if device is tipped over.
5. Simple manufacture and assembly using only four one-piece sections capable of being mass produced at relatively low cost.
6. Adaptable to other embodiments suitable for specific placements but utilizing the same herein enumerated principles.

DESCRIPTION OF THE PRIOR ART

While there are numerous examples of prior art devices available the disclosures of U.S. Pat. Nos. 2,221,300 and 3,840,027 are cited herein as showing many of the individual features explained above. For example U.S. Pat. No. 3,840,027 is directed to a combination cigarette extinguisher and ash tray having many features of the present invention. A review of that patent, however, should point to the complicated structure that is used making manufacture more costly than the present invention and replacement of parts more difficult. Further ashes, once disposed, are not hidden from view. Still further, such device is not easily adaptable to other embodiments and therefor is unsuitable for specific placements different than that disclosed.

Referring to U.S. Pat. No. 2,221,300, it can be seen that disposed ashes are not entirely out of sight although the structural concept is similar in part to the present invention. Further, that ash tray dislosed in that patent does not have a replaceable protective edge member nor does it provide for a lit cigarette extinguishing capability.

SUMMARY OF THE INVENTION

The specific preferred embodiment of the present invention described herein incorporates a cigarette extinguisher and ash disposal device made from four replaceable one-piece sections including a cigarette extinguisher unit, an ash disposal unit, a cigarette extinguisher unit mounting member and protective edge cover. The cigarette extinguisher unit has in the disclosed preferred embodiment four elongated tubular shaped cavities for retaining cigarettes and/or cigars in an upright position. The lower portion of each cavity is spherical in shape immediately above which is a neck portion having an inner diameter smaller than the inner diameter of the remaining tubular portion of that cavity. The cigarette extinguisher unit support member is formed and a downward sloped extending flange so dimensioned that the perimeter of its outer rim is greater than the inner rim diameter of the protective edge cover.

DETAILED DESCRIPTION OF THE PREFERRED EMBODIMENT

Figure 1:
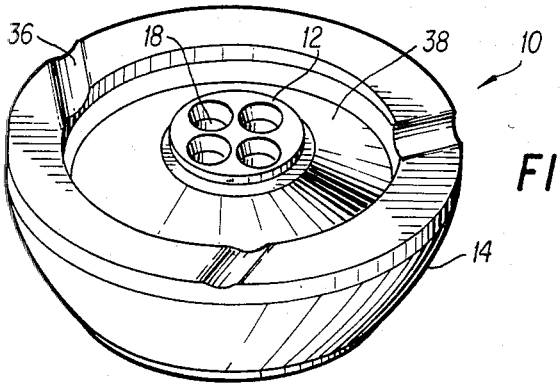
FIG. 1 is a perspective view of the assembled combination cigarette extinguisher and ash disposal device.
Figure 2:
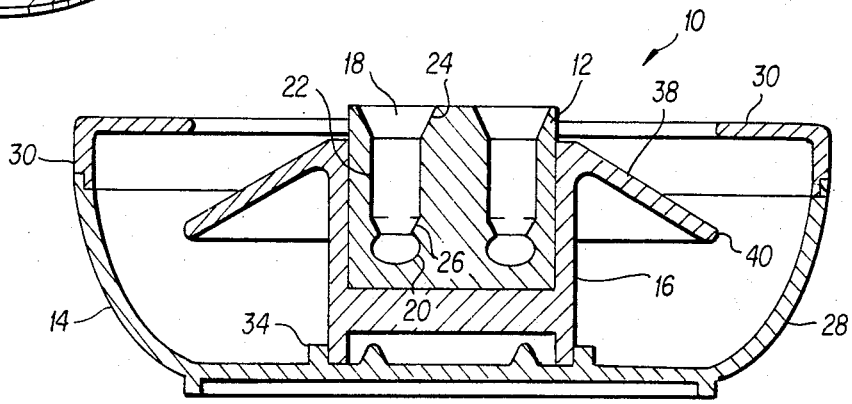
FIG. 2 is a side elevational view of the device with portions broken away to better illustrate the component parts.
Figure 3:
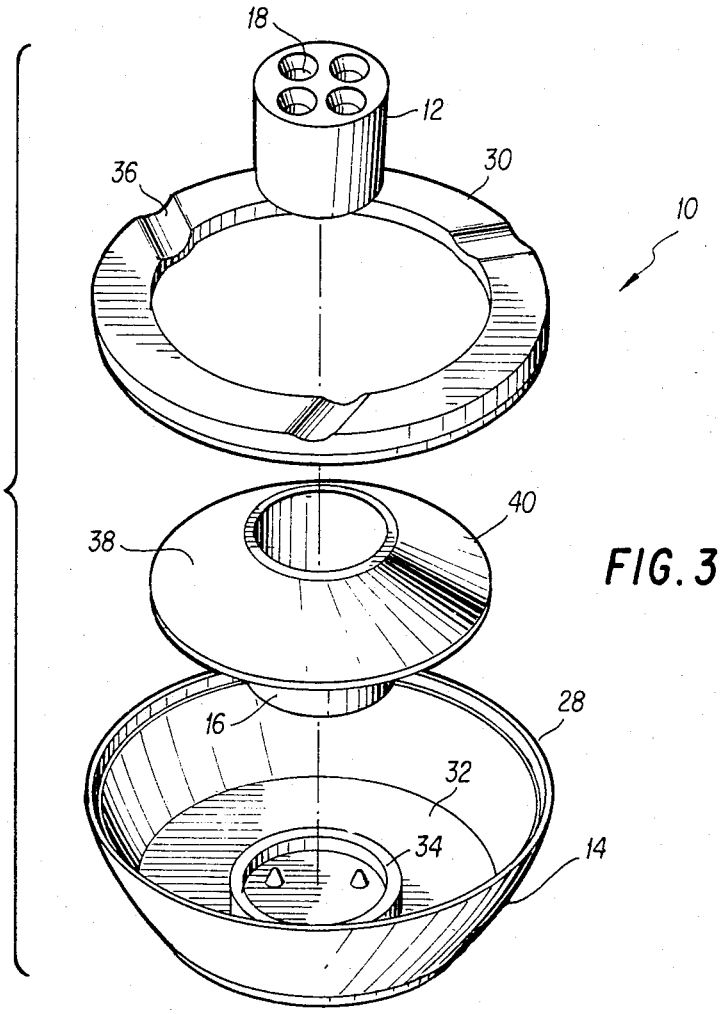
FIG. 3 is an exploded perspective view of member sections.

Referring to the drawings, the reference numeral 10 generally designates a combination cigarette extinguisher and ash disposal unit which includes cigarette extinguisher section 12 and ash disposal unit 14. Cigarette extinguisher section 12 preferably is a one-piece unit fabricated from readily available suitable material and is removeably mounted on support 16 as shown in FIG. 2. In the preferred embodiment, section 12 includes four elongated cavities 18 into which a lit cigarette or cigar may be inserted for the purpose of extinguishing same. Each cavity 18 is identical and includes a generally spherical section 20, tubular section 22 and cigarette guide section 24. Located above section 20 at the lower end of tubular section 22 is neck 26 having an inner diameter smaller than the diameter of the rest of tubular section 22.

Ash disposal unit 14 includes a one-piece main body portion 28 and removeably mounted protective edge cover 30. Integrally formed on the interior base portion 32 of unit 14 is a raised area 34 formed to removeably receive support 16 as shown. Protective edge cover 30 has formed therein indentations 36 that provide a support area to place lit cigarettes.

Support 16 is a one-piece member formed with a downward sloped extending flange 38 so dimensioned that the outer rim 40 has a perimeter that is greater than the inner rim perimeter of protective edge cover 30.

Thus, the invention described results in the accomplishments of the desired features enumerated in the BACKGROUND OF THE INVENTION portion of the disclosure. Specifically, a combination cigarette extinguishing and ash disposal device is disclosed that provides indentations 36 to place cigars or cigarettes temporarily whether lit or unlit. Should a smoker desire to extinguish a cigarette so that it could be smoked at a later time, such lit cigarette can be inserted in any of the four cavities 18. Guide section 24 allows for easy insertion through tubular section 22 of a cavity 18. The edge will be stopped at neck 26 so that the lit portion of the inserted cigarette will protrude into spherical portion 20. The oxygen trapped in spherical portion 20 will immediately become consumed resulting in a clean, non-polluting suffocation of the burning tobacco. In the alternative, should a smoker desire to rid a lit cigarette of its ashes, the placing of such ashes on flange 38 of support 16 will result in those ashes falling into the area formed in ash disposal unit 14. Since the edge 40 of flange 38 of greater perimeter than the inner rim perimeter of the protective edge cover 30 it extends under cover 30 so that the ashes once in unit 14 cannot be seen.

It is understood that various changes may be made in the form of the invention herein shown and disclosed without departing from the spirit of the invention or the scope of the following claims.

What is claimed is:

1. A combination cigarette extinguisher and ash disposal device including:

a cigarette extinguishing portion, a flanged portion having means for mounting said cigarette extinguishing portion therein, an ash receiving portion having means for mounting said flanged portion, a cigarette resting and protective lid portion mounted directly on said ash receiving portion spaced from said cigarette extinguishing portion and said flanged portion, wherein said cigarette extinguishing portion, said flanged portion, said ash receiving portion and said cigarette resting and protecting lid portion are each single piece construction and are removably connected to each other.

2. The device of claim 1 wherein said cigarette extinguishing portion has a plurality of elongated cavities each of which cavity includes a tubular section and generally spherical end section.

3. The device of claim 2 wherein said spherical end section of each of said cigarette extinguishing cavity has a neck with a smaller diameter than the diameter of said tubular section.

4. The device of claim 2 wherein the perimeter of the outer edge of said flanged portion is greater than the perimeter of the inner edge of said cigarette resting and protective lid portion so that said flange portion and said cigarette resting and protective lid portion form a cover for said ash receiving portion.

* * * * *